US008733268B2

(12) United States Patent
Beaty

(10) Patent No.: US 8,733,268 B2
(45) **Date of Patent: *May 27, 2014**

(54) ANCHORING SYSTEM FOR A KAYAK

(75) Inventor: Benny R. Beaty, Houston, TX (US)

(73) Assignee: Benny R. Beaty, Houston, TX (US)

( * ) Notice: Subject to any disclaimer, the term of this patent is extended or adjusted under 35 U.S.C. 154(b) by 114 days.

This patent is subject to a terminal disclaimer.

(21) Appl. No.: 13/336,877

(22) Filed: Dec. 23, 2011

(65) Prior Publication Data

US 2012/0090522 A1 Apr. 19, 2012

Related U.S. Application Data

(63) Continuation-in-part of application No. 12/952,119, filed on Nov. 22, 2010, now Pat. No. 8,082,869, which is a continuation of application No. 12/185,113, filed on Aug. 3, 2008, now Pat. No. 7,861,661.

(51) Int. Cl.
*B63B 21/00* (2006.01)

(52) U.S. Cl.
USPC ..... 114/347; 114/293; 114/230.1

(58) Field of Classification Search
USPC ..... 114/347, 293, 230.1
See application file for complete search history.

(56) References Cited

U.S. PATENT DOCUMENTS 415,501 A 11/1889 Cole
2,009,356 A 7/1935 De Seversky
2,092,011 A 9/1937 Musham
2,526,953 A 10/1950 Kruse
2,881,591 A 4/1959 Rimsey
2,991,750 A 7/1961 Letourneau
3,238,912 A 3/1966 Perlick
5,025,746 A 6/1991 Boulter
5,062,376 A 11/1991 Tremblay
6,041,730 A 3/2000 Oliverio
6,220,197 B1 4/2001 Pohlman
6,273,016 B1 8/2001 Gibbs
7,861,661 B2 * 1/2011 Beaty ..... 114/230.1
8,082,869 B2 * 12/2011 Beaty ..... 114/230.1
2002/0108544 A1 8/2002 Hsu
2006/0207489 A1 9/2006 Waldrop
2007/0181051 A1 8/2007 Waldrop
2010/0024712 A1 2/2010 Beaty
2011/0061580 A1 3/2011 Beaty

* cited by examiner

*Primary Examiner* — Stephen Avila

(57) ABSTRACT

Apparatus and system are disclosed for anchoring a kayak to the bottom of a body of shallow water. In one embodiment, the apparatus includes a tube for attachment to the kayak proximate the upper portion of the kayak between the bow and the stern of the kayak, and a shaft which is disposed in the tube. A gear box is provided proximate the seat which comprises a gearing mechanism for operative engagement with the shaft, and a rotatable handle which is external to the gear box for operative connection to the gearing mechanism. The rotatable handle, when rotated in a first direction, deploys the shaft from a position inside the tube to a position outside the tube and into engagement with the bottom of the body of water. An anchoring system according to this embodiment permits the operator of the kayak to anchor the kayak at the bow or stern.

20 Claims, 16 Drawing Sheets

ANCHORING SYSTEM FOR A KAYAK

CROSS-REFERENCE TO RELATED APPLICATIONS

This application is a continuation-in-part of U.S. application Ser. No. 12/952,119, filed Nov. 22, 2010, now U.S. Pat. No. 8,082,869, issued Dec. 27, 2011, which in turn is a continuation of U.S. application Ser. No. 12/185,113, filed Aug. 3, 2008, now U.S. Pat. No. 7,861,661 issued Jan. 4, 2011.

BACKGROUND OF THE INVENTION

1. Field of the Invention

The present invention relates to a system for anchoring a kayak in shallow water.

2. Description of the Prior Art

Fishing is a popular sport, and this popularity has prompted the development of many fishing aids designed to assist the fisherman. Fishermen frequently need to maintain the position of their boats, and various techniques have been developed which purport to assist the fisherman in that regard. Such techniques are, for example, disclosed in U.S. Patent Application Publication 2006/0207489; U.S. Pat. No. 6,273,016; U.S. Pat. No. 3,238,912; and U.S. Pat. No. 5,062,376.

Kayaking and kayak fishing have grown in popularity in recent years, and since the kayak is a lightweight craft, winds and currents may often cause the kayak to drift away from a desired position. It is often essential, therefore, that the kayak operator (whether fisherman or photographer) be able to anchor his or her kayak at a particular location. Anchoring systems for kayaks have, however, been quite rustic and have consisted for the most part of a weight attached to a rope which the kayak operator drops into the water near the seat of the kayak to anchor the kayak. These weights tend to be noisy when deployed and such noise tends to scare away the fish or other wildlife in the vicinity of the kayak. Also, such weights tend to be bulky and cumbersome to use.

It is often advantageous to be able to anchor a boat both at the bow and the stern of the boat, and this would be especially true in the case of a lightweight kayak. Developing a suitable system for anchoring a kayak both at the bow and the stern is complicated by the fact that the operator of a kayak must remain seated or run the very substantial risk of capsizing the kayak, if the operator were to attempt a move from the seat of the kayak to another position on the kayak.

A system which allows a kayak operator to anchor the kayak either at the bow or the stern of the kayak or both and to do so from the seat of the kayak using only one hand would be desirable. This new and useful result has been achieved by the anchoring system of the present invention.

SUMMARY OF THE INVENTION

In accordance with the present invention, apparatus is provided for anchoring a kayak to the bottom of a body of water. The kayak comprises a hull having a bow and stern and upper and lower portions and a seat disposed in the hull between the bow and stern. In one embodiment, the anchoring apparatus comprises a tube which may be attached to the kayak proximate the upper portion of the kayak between the bow and stern of the kayak. A shaft is installed in the tube, and the shaft is preferably a rack and pinion gear driven shaft. In this embodiment, anchoring apparatus according to the present invention further comprises a gear box which may be attached to the kayak proximate the seat of the kayak, where the gear box comprises a gear for operative engagement with the shaft, and a rotatable handle external to the gear box for operative connection to the gear in the gear box. When the handle is rotated in a first direction, the shaft is deployed from a position inside the first tube to a position outside of the first tube and into engagement with the bottom of a body of water. The shaft may be returned to the tube by rotating the handle in the opposite direction from which it was rotated to deploy the shaft.

In one embodiment, the shaft is deployed from the tube at a location proximate the bow of the kayak, while in a second embodiment, the shaft is deployed from the tube at a location proximate the stern of the kayak.

In another embodiment, apparatus for anchoring a kayak to the bottom of a body of water is provided where the apparatus comprises first and second tubes which may be attached to the kayak proximate the upper portion of the kayak between the bow and stern of the kayak. First and second shafts are disposed in the first and second tubes, respectively, and these shafts may be deployed from the tubes and into engagement with the bottom of the body of water. Anchoring apparatus in this embodiment also comprises a gear box which may be attached to the kayak proximate the seat of the kayak which comprises a first gearing mechanism for operative engagement with the first shaft and a second gearing mechanism for operative engagement with the second shaft. A rotatable handle external to the gear box is provided for operative connection to the first and second gearing mechanisms in the gear box.

The gear box further comprises first and second actuation devices which are external to the gear box and which have first and second positions. When the first and second actuation devices are in their respective first positions, operative connection is enabled between the first and second gearing mechanisms and the handle, so that when the handle is rotated in a first direction, the first and second shafts are deployed out of the first and second tubes. The shafts, when deployed, engage the bottom of the body of water and anchor the kayak. When the first and second actuation devices are in their respective second positions, operative connection between the first and second gearing mechanisms and the handle is disabled.

In one embodiment of the present invention, the actuation devices comprise switches, while in another embodiment, the actuation devices comprise levers.

Anchoring apparatus according to the present invention further comprises rollers in the tubes on which the shafts move as they are deployed. The shafts may also comprise at least one connector bolt to permit rotation of the shaft as it is deployed.

Various accessories may be included in embodiments of the anchoring apparatus of the present invention. For example, such accessories may include foldable lights which are attached to the tubes to permit the kayak to be seen at times when lighting is dim. Additionally, such accessories may include depth indicators on the shafts. Such depth indicators may, for example, be implemented by forming a window in each tube and applying markings to the shafts to indicate the depth to which each shaft has been deployed. A further accessory may comprise a paddle holder.

In another embodiment of the present invention there is disclosed an apparatus for anchoring a kayak to the bottom of a body of water, the kayak comprising a hull having a bow and a stern and upper and lower portions, and a seat disposed in the hull between the bow and stern, the anchoring apparatus comprising: a tube for attachment to the kayak proximate the upper portion of the kayak between the bow and the stern of the kayak, wherein the tube has first and second opposed ends, a central substantially horizontal section between the opposed ends, and a length equal to approximately the length of the kayak, and wherein the tube ends are directed generally downward. In this embodiment, the apparatus also comprises a shaft in the tube, wherein the shaft has first and second opposed ends. The embodiment also includes a gear box for attachment to the kayak proximate the seat which comprises: (i) a gear for operative engagement with the shaft; and (ii) a rotatable handle external to the gear box for operative connection to the gear in the gear box. The rotation of the handle in a first direction causes the shaft to deploy from a position inside the tube to a position outside the tube from the generally downwardly directed first tube end and into engagement with the bottom of the body of water. The rotation of the handle in a second direction, opposite the first direction, causes the shaft, if already deployed, to return into the tube, and if desired, to deploy from a position inside the tube to a position outside the tube from the generally downwardly directed second tube end and into engagement with the bottom of the body of water.

The shaft may be deployed from the tube at a location proximate to the bow or stern of the kayak. The apparatus may further comprise rollers in the tube on which the shaft moves as it is deployed. In one embodiment, at least one connector bolt in the shaft to permit rotation of the shaft as it is deployed. As with prior embodiments, this embodiment may further comprise one or more accessories selected from the group consisting of: a foldable light which is attached to the tube; a depth indicator for the shaft; and a paddle holder. The shaft may further comprise a rack and pinion gear driven shaft. The shaft may further comprise a toothed portion for operative engagement with the gear in the gear box. The shaft may further comprise a probe portion on the end of the shaft that is deployed from the tube, for engagement with the bottom of the body of water. In one embodiment, the shaft further comprises a probe portion on each end of the shaft, for engagement with the bottom of the body of water, when one end of the shaft is deployed from the tube. The probe portion(s) may be rotatably attached to the shaft with a connector bolt(s). The gear box may further comprise a housing having an openable and closeable access to permit maintenance of the gear works.

The apparatus may also be outfitted with a locking mechanism for preventing the gear from turning or to prevent the shaft from being further deployed. In one embodiment, the handle is configured to be collapsible into a storage position, in another embodiment, the handle is not collapsible. The apparatus may also be equipped with a scraper to scrape debris off of the deployed shaft as the deployed shaft is directed back into the tube. The tube may be of unitary construction or comprises attachable and detachable tube segments.

In another embodiment of the present invention, there is described a kayak anchoring system for anchoring a kayak to the bottom of a body of water, comprising: (a) a kayak comprising a hull having a bow and a stern and upper and lower portions, and a seat disposed in the hull between the bow and stern; (b) a tube for attachment to the kayak proximate the upper portion of the kayak between the bow and the stern of the kayak, wherein the tube has first and second opposed ends, a central substantially horizontal section between the opposed ends, and a length equal to approximately the length of the kayak, and wherein the tube ends are directed generally downward; (c) a shaft in the tube, wherein the shaft has first and second opposed ends; and (d) a gear box for attachment to the kayak proximate the seat which comprises: (i) a gear for operative engagement with the shaft; and (ii) a rotatable handle external to the gear box for operative connection to the gear in the gear box; the rotation of the handle in a first direction causing the shaft to deploy from a position inside the tube to a position outside the tube from the generally downwardly directed first tube end and into engagement with the bottom of the body of water; the rotation of the handle in a second direction, opposite the first direction, causing the shaft, if already deployed, to return into the tube, and if desired, to deploy from a position inside the tube to a position outside the tube from the generally downwardly directed second tube end and into engagement with the bottom of the body of water.

In yet another embodiment of the present invention, there is disclosed and described an apparatus for anchoring a kayak to the bottom of a body of water, the kayak comprising a hull having a bow and a stern and upper and lower portions, and a seat disposed in the hull between the bow and stern, the anchoring apparatus comprising: a tube for attachment to the kayak proximate the upper portion of the kayak between the bow and the stern of the kayak, wherein the tube has first and second opposed ends, a central substantially horizontal section between the opposed ends, and a length equal to approximately the length of the kayak, and wherein the tube ends are directed generally downward; a shaft in the tube, wherein the shaft has first and second opposed ends capable of engagement with the bottom of the body of water when deployed from the tube; and a gear box for attachment to the kayak proximate the seat which comprises: (i) a gear for operative engagement with the shaft; and (ii) a rotatable handle external to the gear box for operative connection to the gear in the gear box; the rotation of the handle in a first direction causing the shaft to move in a first direction, the rotation of the handle in a second direction causing the shaft to move in a second direction opposite the first direction; the first end of the shaft being deployable in and out of the first end of the tube, the second end of the shaft being deployable in and out of the second end of the tube.

DESCRIPTION OF THE SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 1:
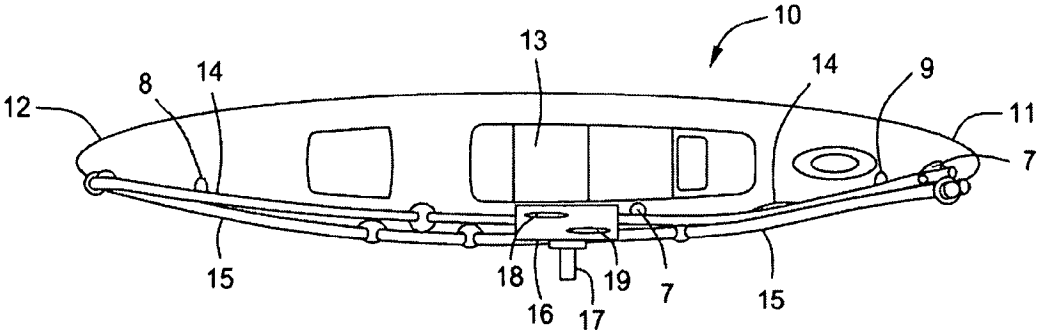
FIG. 1 is a top view of a kayak containing anchoring apparatus in accordance with the present invention.
Figure 2:
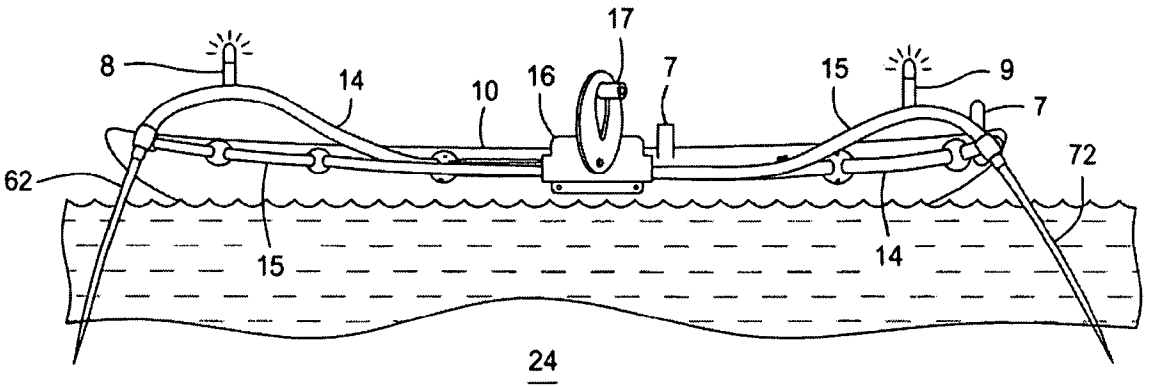
FIG. 2 is a side view of the kayak illustrated in FIG. 1.

With reference first to FIGS. 1 and 2, there is illustrated a kayak 10 having a bow 11 and a stern 12. Interposed between the bow 11 and the stern 12 is a seat 13 for the operator. One embodiment of an anchoring system in accordance with the present invention comprises tubes 14 and 15 which may be attached to one side of kayak 10 and have a length equal to approximately the length of the kayak 10. Interposed between the ends of tubes 14 and 15 is a gear box 16 which comprises a handle 17 and actuation devices (as discussed below) and which may be attached to the kayak proximate the operator's seat 13.

While the anchoring system in FIG. 1 is illustrated as being installed on the right-hand side of kayak 10, those skilled in the art who have the benefit of the present disclosure will appreciate that the anchoring system comprising tubes 14 and 15 and gear box 16 may instead be installed on the left-hand side of kayak 10.

Figure 3A:
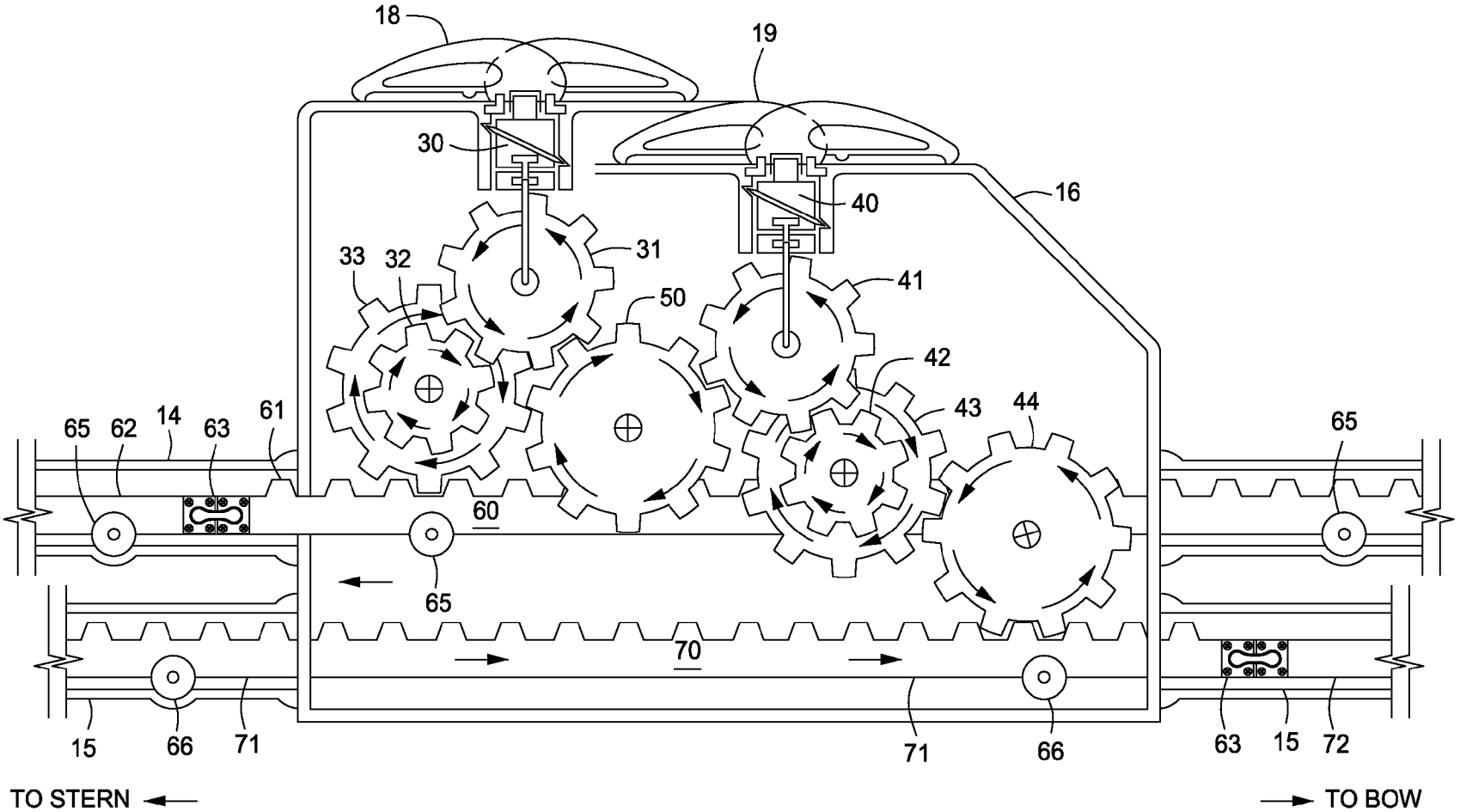
FIG. 3A is an elevation drawing in partial cross-section of a gear box that is used in one embodiment of the anchoring system of the present invention.
Figure 3B:
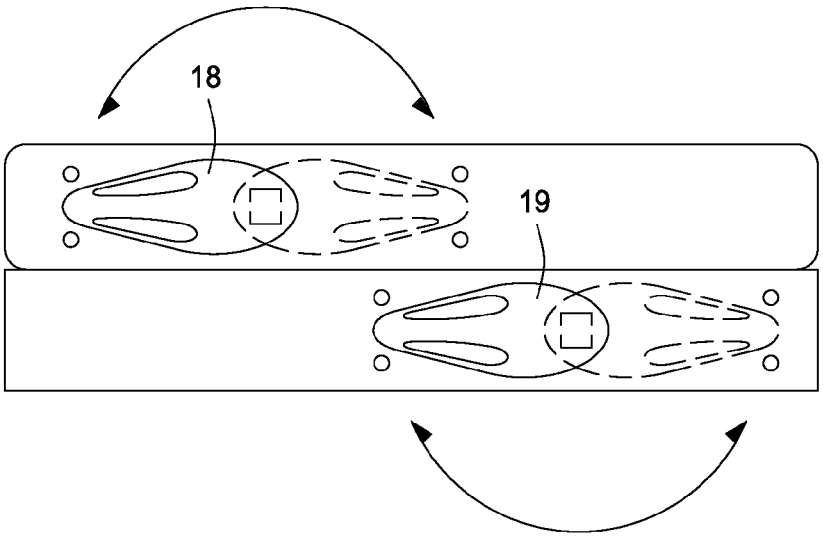
FIG. 3B is a top view of the gear box illustrated in FIG. 3A.

With reference now to FIGS. 3A and 3B, one embodiment of gear box 16 is illustrated. In this embodiment, the actuation devices comprise switches 18 and 19 which have two positions which are 180° apart and which are illustrated most clearly in FIG. 3B. Switch 18 is connected via swivel bolt 30 to gear wheel 31. Switch 19 is connected via swivel bolt 40 to gear wheel 41. Turning switch 18 between its two positions which are 180° apart raises and lowers gear wheel 31 into engagement or disengagement with gear wheel 50 and gear wheels 32 and 33. Similarly, turning switch 19 between its two positions which are 180° apart raises and lowers gear wheel 41 into engagement or disengagement with gear wheel 50 and the gear wheels 42, 43 and 44. The gear wheel 50 is connected to handle 17. Switch 18, when in a first position such that gear wheel 31 is lowered, functions to enable operative connection between the gear wheels 32 and 33 and the handle 17, and when switch 18 is in its second position such that gear wheel 31 is not lowered, operative connection between the gear wheels 32 and 33 and the handle 17 is disabled. Similarly, switch 19, when in a first position such that the gear wheel 41 is lowered, functions to enable operative connection between the gear wheels 42, 43 and 44 and the handle 17, and when switch 19 is in its second position such that gear wheel 41 is not lowered, operative connection between the gearwheels 42, 43 and 44 and the handle 17 is disabled.

Figure 6:
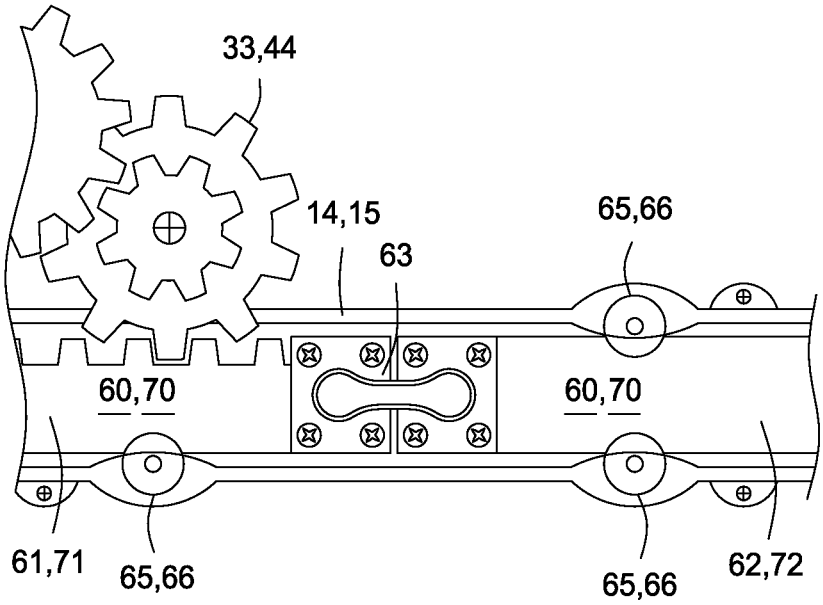
FIG. 6 is a cross-sectional view of one of the tubes illustrated in FIG. 1 taken along the longitudinal axis of the tube.

With reference now to FIGS. 2, 3A and 6, each tube 14, 15 contains a shaft 60, 70 comprising a toothed portion 61, 71, respectively, and a probe portion 62, 72, respectively, where the probe portions 62, 72 have a smooth surface to facilitate penetration into the bottom 24 of a body of water. Toothed portions 61, 71 may be joined to probe portions 62, 72, respectively, by utilizing connector bolts 63 which permits the probe portions 62, 72 to rotate. Gear wheel 33 engages the toothed portion 61 of the shaft 60, and gear wheel 44 engages the toothed portion 71 of the shaft 70.

Figure 4A:
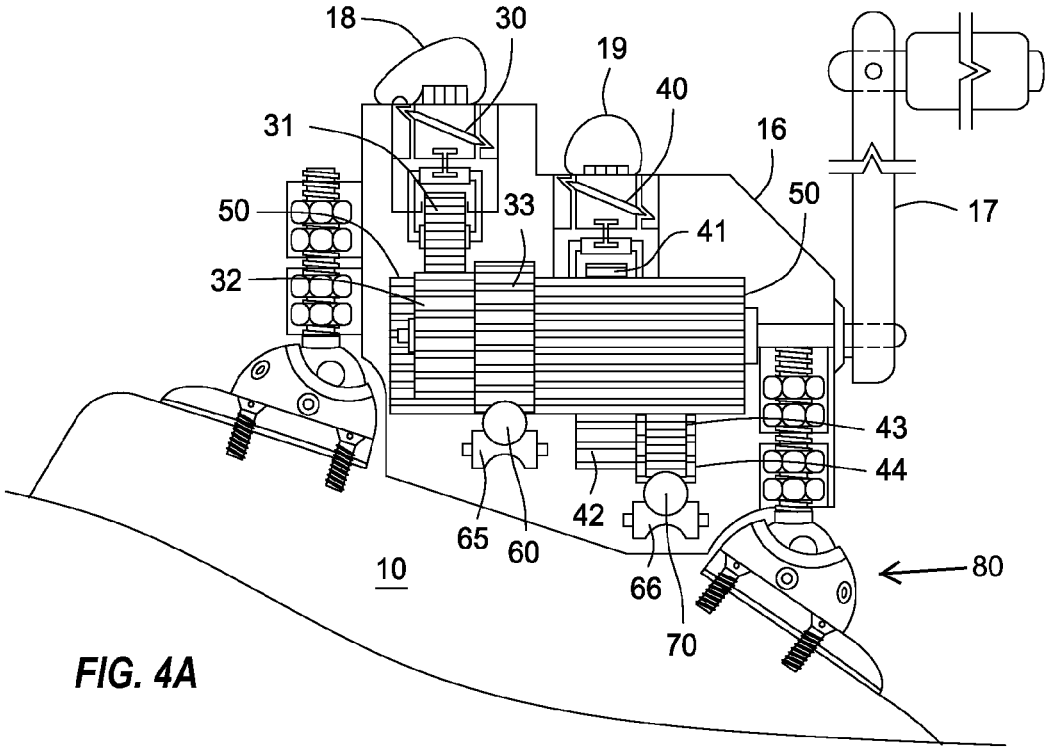
FIG. 4A is an elevation view in partial cross-section of the gear box illustrated in FIGS. 3A and 3B.

Referring now to FIG. 4A, the internal mechanisms of gear box 16 when viewed from the stern end of the gear box are illustrated. FIG. 4A illustrates the spatial relationship between switch 18, swivel bolt 30, and gear wheels 31, 32, 33 and 50. FIG. 4A also illustrates the spatial relationship between switch 19, swivel bolt 40, gear wheel 50 and gear wheels 41, 42, 43 and 44.

Figure 4B:
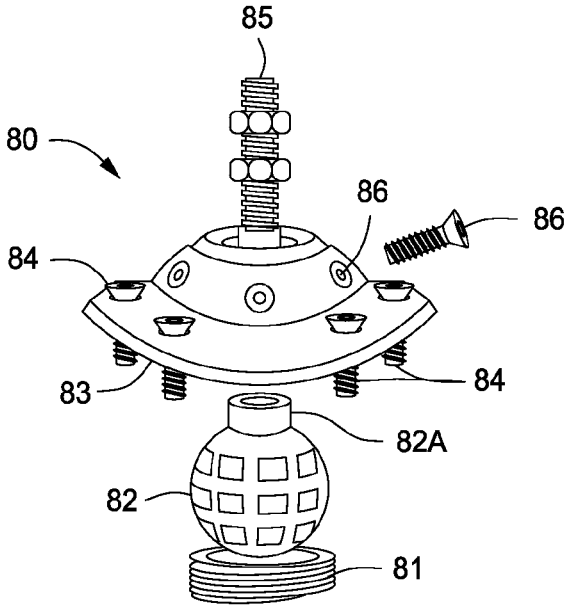
FIG. 4B is an exploded drawing of apparatus used to mount the gear box illustrated in FIG. 4A or in FIG. 5A to a kayak.

As illustrated in FIG. 4B, gear box 16 may advantageously be secured to kayak 10 by utilizing a plurality of mounting assemblies 80, and, in one embodiment, four such mounting assemblies are utilized. Mounting assembly 80 comprises base material 81 on which rotating ball 82 is disposed. A mounting base 83 fits over the cylindrical extension 82*a* of rotating ball 82 and is secured to the kayak 10 by utilizing a plurality of mounting screws 84. Adjusting bolt 85 may then engage the threaded portion of cylindrical extension 82*a*, and the orientation of adjusting bolts 85 may be determined by using a plurality of set screws 86.

In operation, the operator of the kayak 10 may elect to anchor the kayak at either the stern or at the bow or at both the stern and the bow simultaneously. In order to anchor the kayak both at the bow and the stern, switches 18 and 19 are each placed in the first position such that gear wheels 31 and 41, respectively, are lowered into operative engagement with gear wheels 32, 33, 50, 42, 43 and 44. The operator of the kayak then turns the handle 17 in a clockwise direction to lower the probe portions of shafts 60 and 70 into the bottom of the body of water in which the kayak is operating. As illustrated in FIGS. 3A and 6, a plurality of rollers 65, 66 may be included in each tube 14, 15, respectively, to facilitate movement of the shafts in the tubes by reducing friction. When the operator of the kayak is ready to weigh anchor, the probe portions of shafts 60 and 70 may be retracted from the anchoring position and into tubes 14 and 15 by turning the handle 17 in a counterclockwise direction.

If the operator desires only to anchor the kayak at the bow, the operator will only actuate the switch 19. Alternatively, if the operator desires to anchor only at the stern, the operator will only actuate the switch 18. If the kayak operator has elected to anchor only at the bow or stern, but later determines that anchoring at both locations is needed, the switch which was initially actuated is de-actuated, the switch which was initially de-actuated is actuated, and the handle 17 is rotated to deploy the other shaft into engagement with the bottom of the body of water.

Figure 5A:
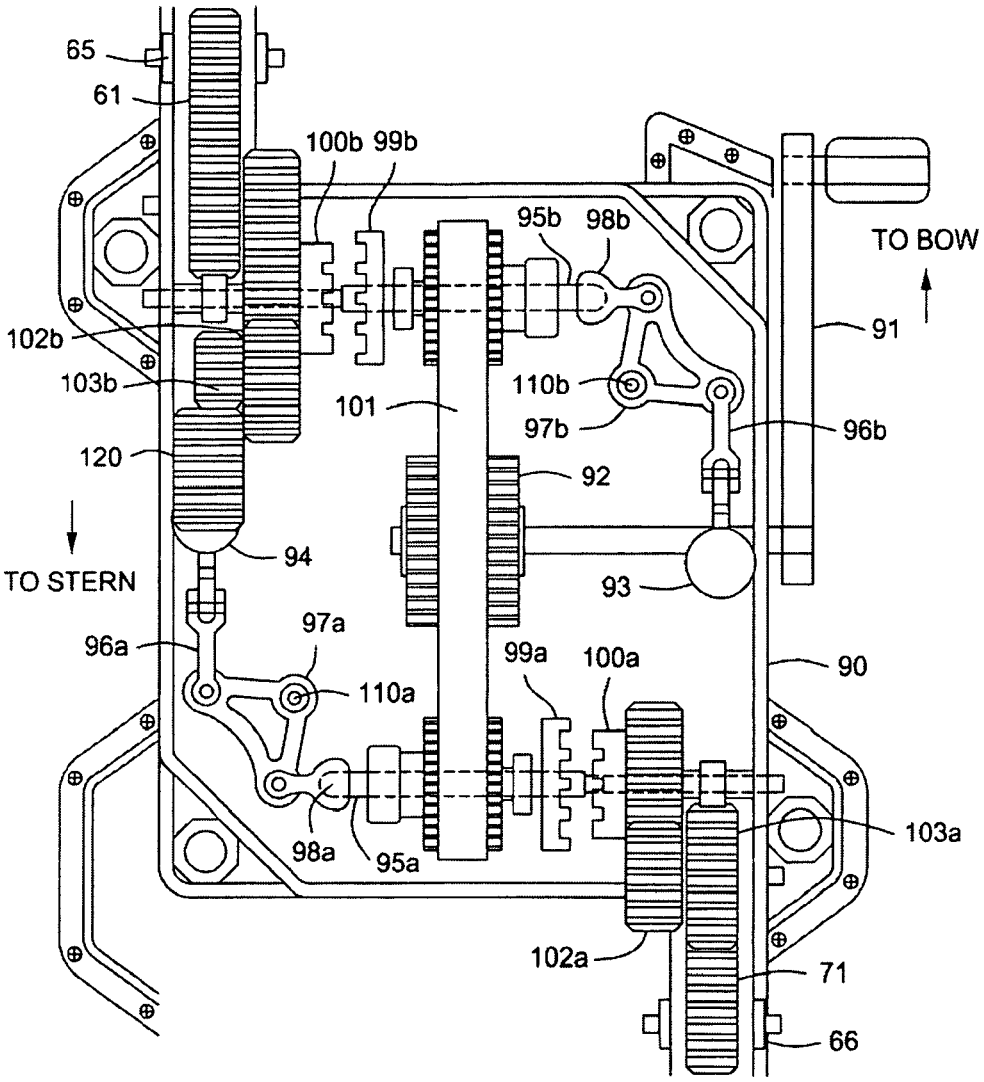
FIGS. 5A and 5B are top views of the interior mechanisms of a gear box according to a second embodiment of an anchoring system of the present invention.
Figure 5B:
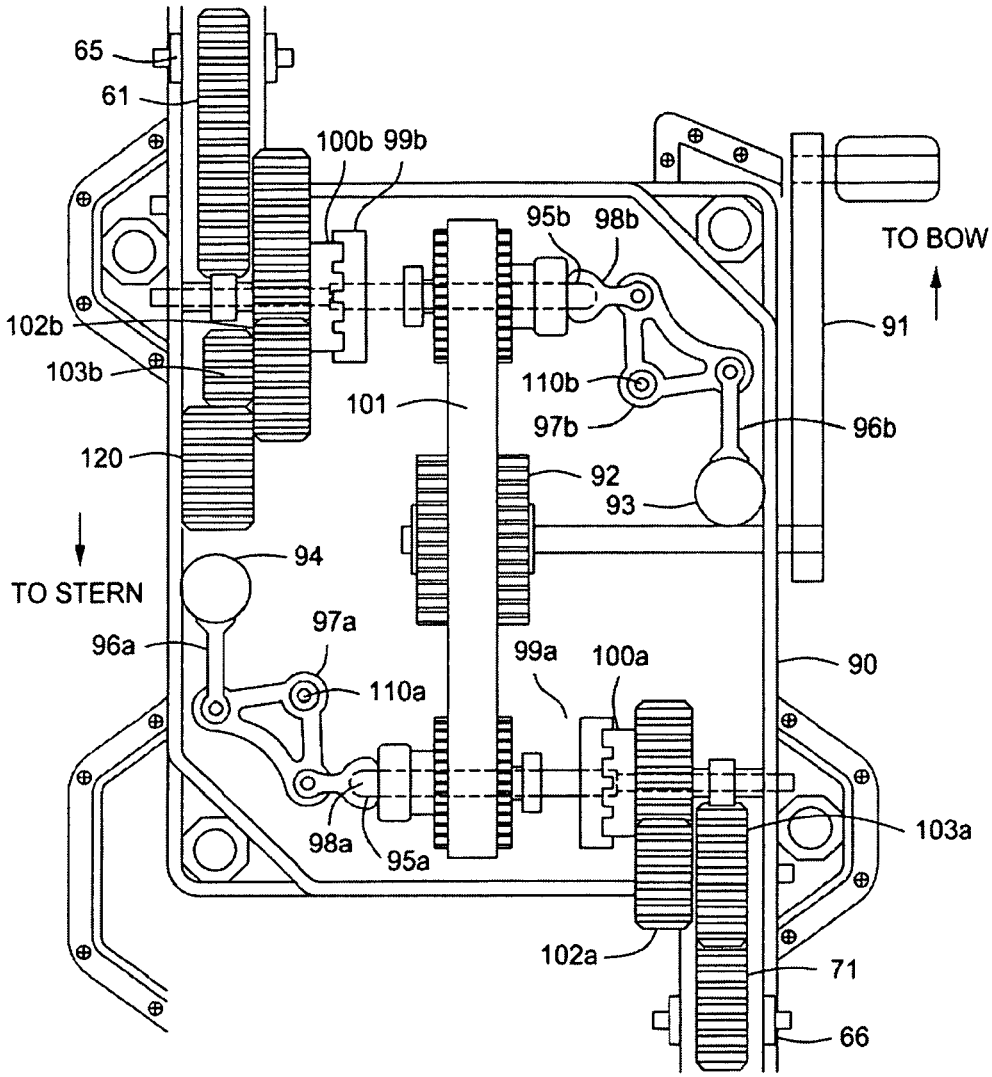
Figure 5C:
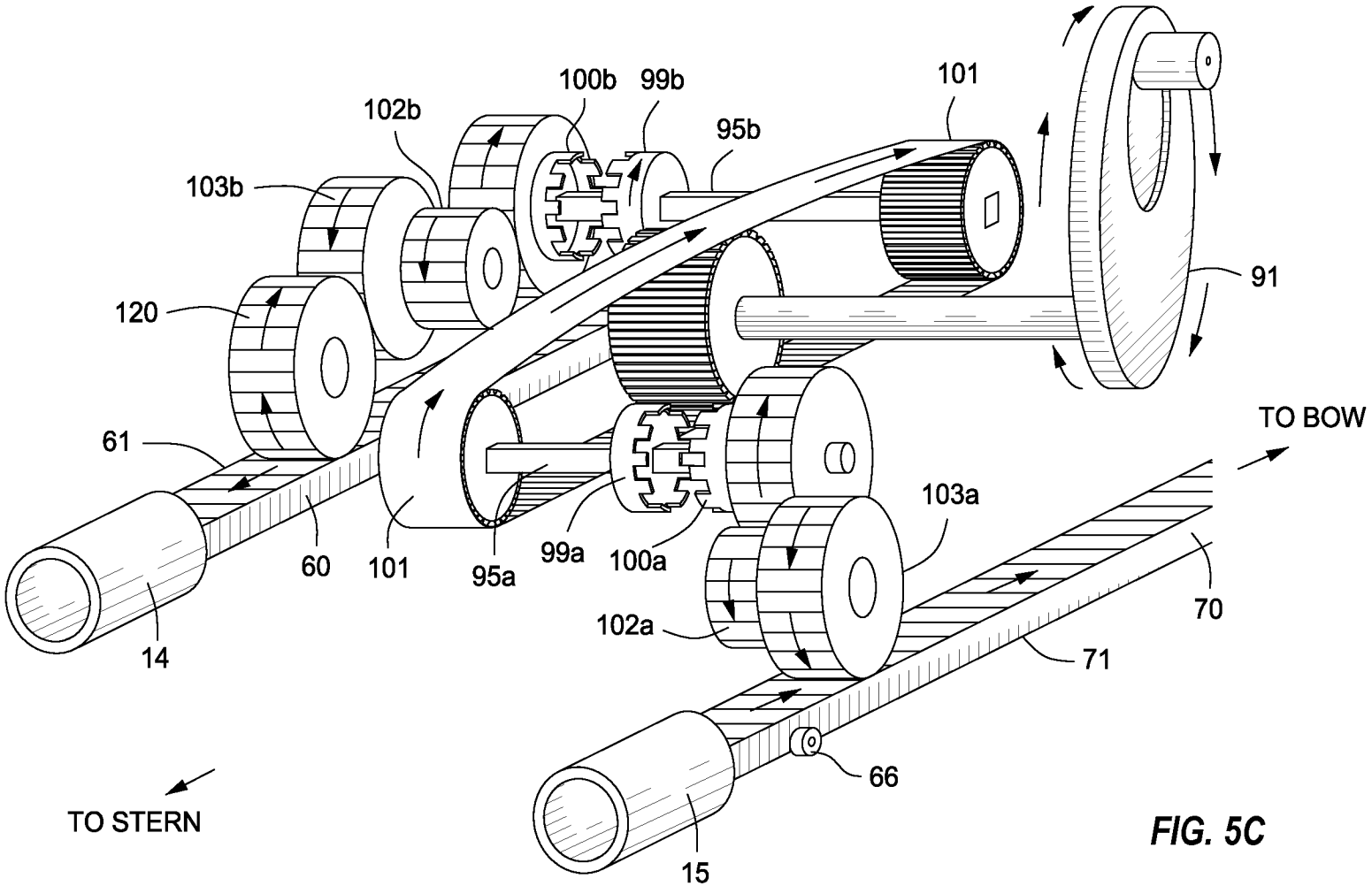
FIG. 5C is a perspective drawing of portions of the interior mechanisms illustrated in FIGS. 5A and 5B.

Referring now to FIGS. 5A, 5B and 5C, an alternative embodiment of a gear box in accordance with the present invention is illustrated. In this embodiment, the gear box 90 comprises a rotatable handle 91 for operative connection to the main gear 92 in gear box 90 and two actuation devices which are external to the gear box. In this embodiment, the actuation devices comprise levers 93 and 94. In FIGS. 5A-5C, the mechanism associated with lever 94 utilizes numeric reference designators which end in the letter "a," while the mechanism associated with lever 93 utilizes numeric reference designators ending in the letter "b." Components of each mechanism having the same numeric reference designator, but differing only in the ending letters "a" and "b" are the same. The following discussion first focuses on the structure and operation of the mechanism operatively connected to lever 94.

Lever 94 is operatively connected to shaft 95*a* via linkage 96*a*, tri-linkage 97*a* and ball linkage 98*a*. Tri-linkage 97*a* is rotatably mounted on hinge pin 110*a*. Shaft cog 99*a* is fixedly attached to shaft 95*a*. Lever ball 94 has two positions, and when lever ball 94 is moved between these two positions, shaft cog 99*a* engages or disengages slip bearing cog 100*a*. FIGS. 5A and 5C illustrate shaft cog 99*a* disengaged from slip bearing cog 100*a*, while FIG. 5B illustrates shaft cog 99*a* in engagement with slip bearing cog 100*a*. When shaft cog 99*a* is in engagement with slip bearing cog 100*a*, rotation of handle 91 drives belt 101, which in turn drives rack gears 102*a* and 103*a*. The teeth of rack gear 103*a* engage the toothed portion 71 of shaft 70, and, depending upon the direction of rotation of handle 91, the movement of rack gear 103 causes the probe portion 72 of shaft 70 either: (a) to leave the tube 15 and engage the bottom of the body of water in which the kayak is operating; or (b) to retract out of the body of water into tube 15.

Still referring to FIGS. 5A, 5B, and 5C, the mechanism operatively connected to lever 93 differs from the mechanism operatively connected to lever 94 by the addition of gear wheel 120. The additional gear wheel engages the toothed portions 61 of shaft 60. When shaft cog 99*b* is in engagement with slip bearing cog 100*b*, rotation of handle 91 causes the probe portion 62 of shaft 60 either: (a) to leave the tube 14 and engage the bottom of the body of water in which the kayak is operating; or (b) to retract out of the body of water into tube 14.

Figure 8:
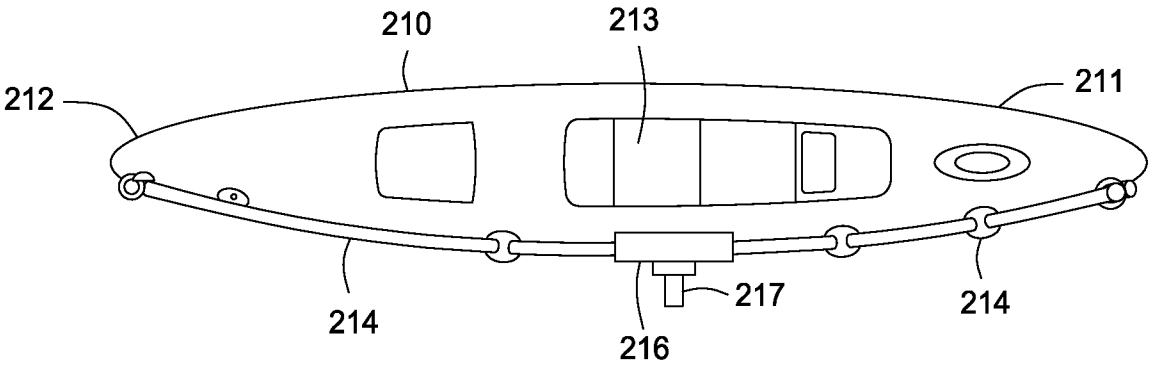
FIG. 8 is a top view of a kayak containing an alternative embodiment of anchoring apparatus in accordance with the present invention.
Figure 9:
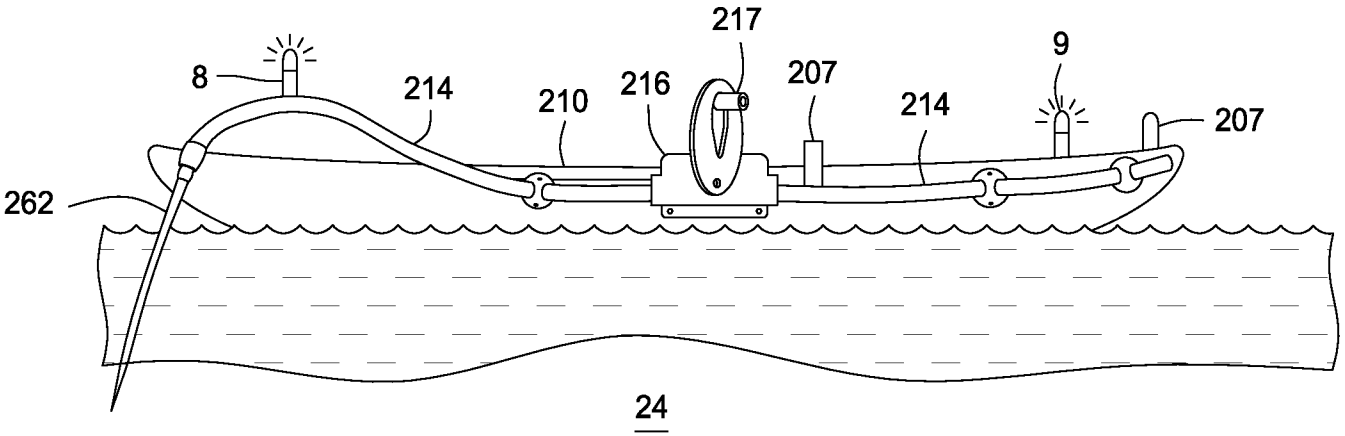
FIG. 9 is a side view of the kayak illustrated in FIG. 8.

Referring now to FIGS. 8 and 9, there is illustrated a kayak 210 having a bow 211, a stern 212 and a seat 213 which is interposed between the bow 211 and the stern 212. An alternative embodiment of an anchoring system in accordance with the present invention comprises tube 214 which has a length equal to approximately the length of kayak 210 and which may be located on either the right-hand or the left-hand side of kayak 210. Interposed between the ends of the tube 214 is a gear box 216 which comprises a handle 217 and which is located proximate the operator's seat 213.

Figure 10:
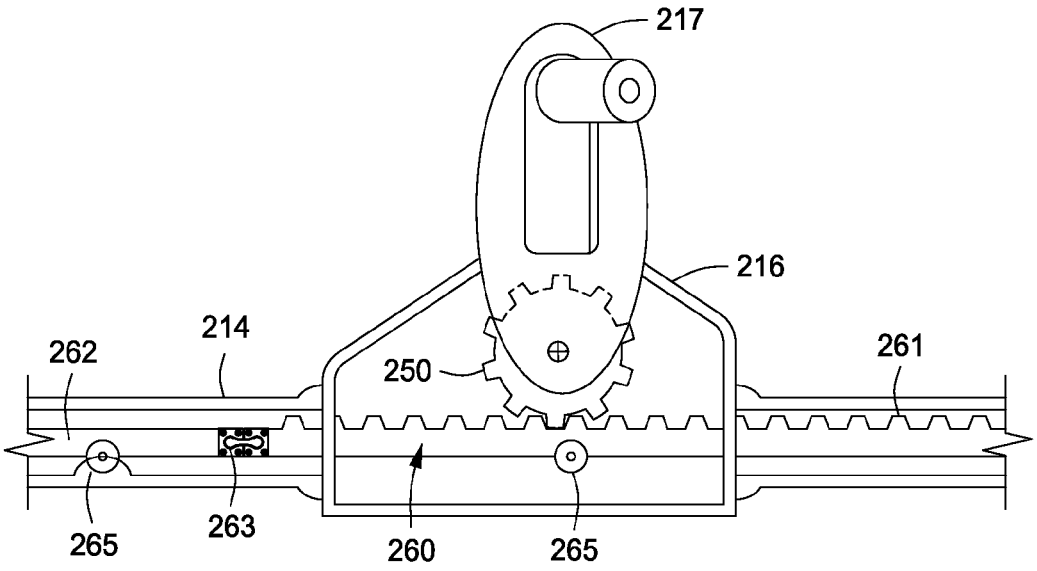
FIG. 10 is an elevation drawing in partial cross-section of a gear box that is used in the alternative embodiment of the anchoring system illustrated in FIGS. 8 and 9.

With reference now to FIG. 10, gear wheel 250 is located inside gear box 216 and is operatively connected to handle 217. The teeth of gear wheel 250 engage the toothed portion 261 of shaft 260. The shaft 260 also includes a probe portion 262 which may advantageously be coupled to the toothed portion 261 by utilizing connector bolt 263. As the handle 217 is rotated in a first direction, the probe portion 262 of shaft 260 is deployed from tube 214 and penetrates the bottom 24 of the body of water in which kayak 210 is floating. As the handle 217 is rotated in the opposite direction, the shaft 260 is retracted into tube 214. Similar to FIGS. 3A and 6, a plurality of rollers 265 may be included in tube 214 to facilitate movement of the shafts in the tubes by reducing friction.

Figure 7:
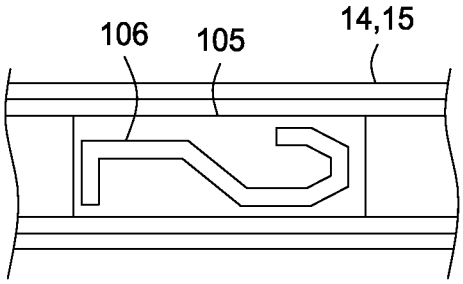
FIG. 7 is a cross-sectional view of a portion of one of the tubes illustrated in FIG. 1 taken along the longitudinal axis of the tube.

Accessories may be provided with anchoring apparatus according to the present invention. For example, with reference to FIG. 2, such accessories may include foldable lights 8, 9 which are attached to tubes 14 and 15, respectively, and which permit the kayak to be identified when lighting is dim. Additionally, such accessories may include depth indicators on the shafts 60, 70 which may be implemented by forming a window 105 in each tube 14, 15 as illustrated in FIG. 7 and applying markings 106 to the shafts 60, 70 to indicate the depth to which each shaft has been deployed. With reference to FIGS. 2 and 9, an additional accessory may comprise paddle holder, which is designated 7 in FIG. 2 and which is designated 207 and FIG. 9.

Figure 11:
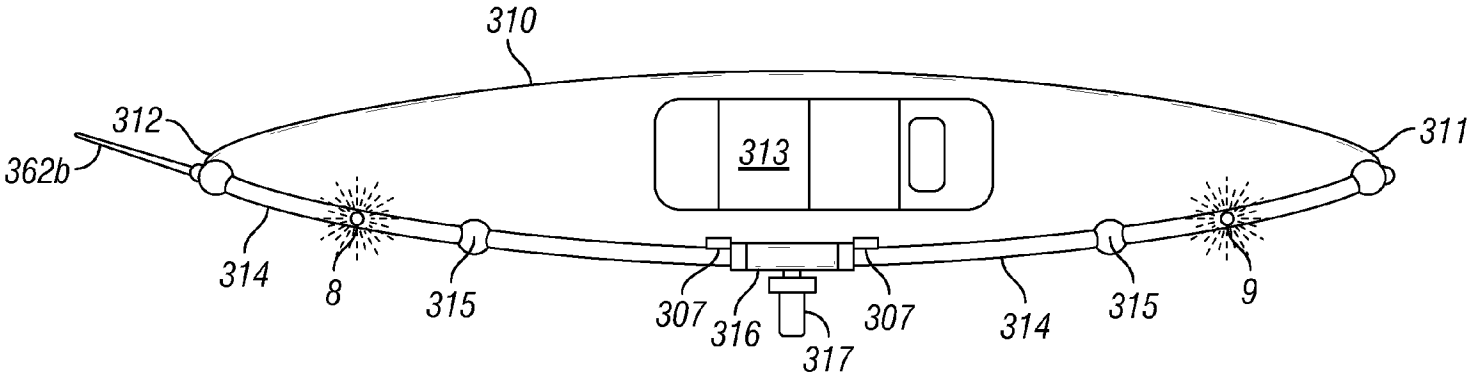
FIG. 11 is a top view of a kayak containing an additional anchoring apparatus embodiment in accordance with the present invention.
Figure 12:
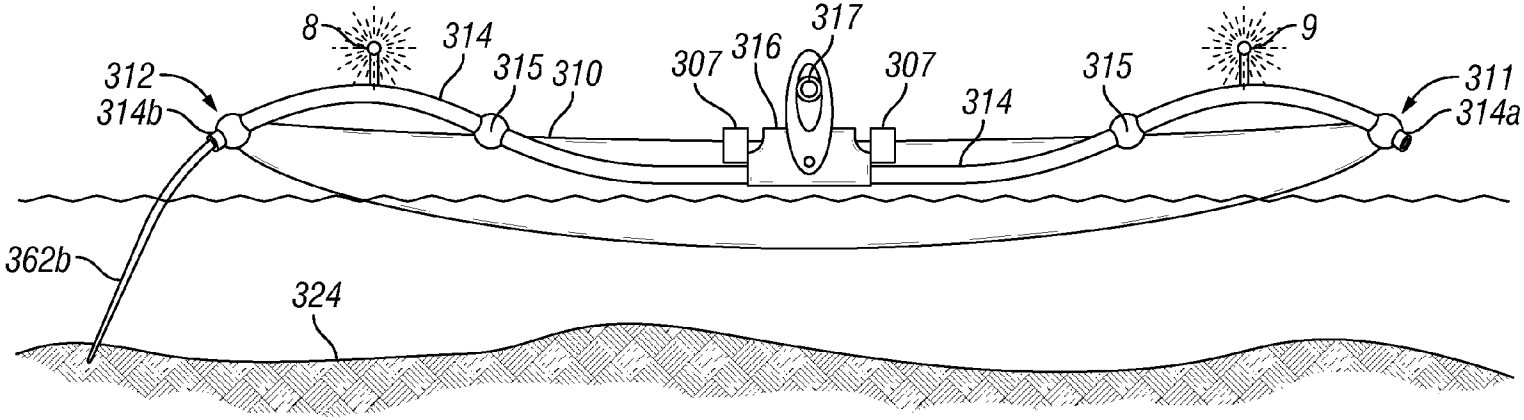
FIG. 12 is a side view of the kayak illustrated in FIG. 11.
Figure 13:
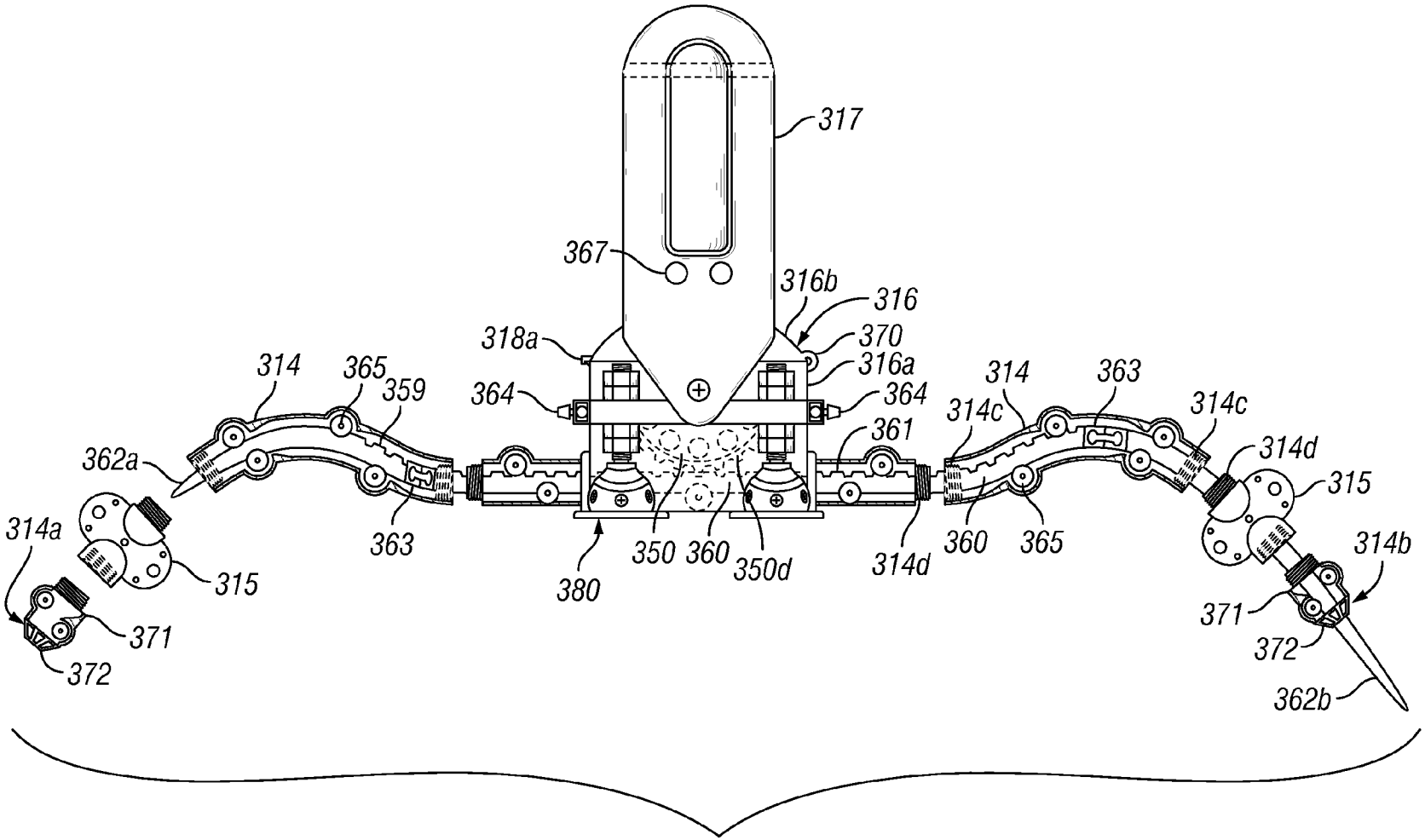
FIG. 13 is an elevation drawing in partial cross-section of an exemplary embodiment of the anchoring system illustrated in FIGS. 11 and 12.

Referring now to FIGS. 11-15, 16A, 16B, 17A, 17B and 18-19 there is depicted another embodiment of the kayak anchoring system of the present disclosure. In FIGS. 11 and 12, there is illustrated a kayak 310 having a bow 311, a stern 312 and a seat 313 which is interposed between the bow 311 and the stern 312. This alternative embodiment of an anchoring system in accordance with the present invention comprises a tube 314 which has a length equal to approximately the length of kayak 310 and which may be mounted on either the right-hand or the left-hand side of the kayak 310 using suitable mounts 315. Interposed between the ends of the tube 314 is a gear box 316 which comprises a handle 317 and which is located proximate the operator's seat 313. The handle 317 is configured to provide 360 degrees of rotation of the gear wheel 350 via axle 369. Optional paddle holders 307 and optional lights 8, 9 may be included.

Figure 14:
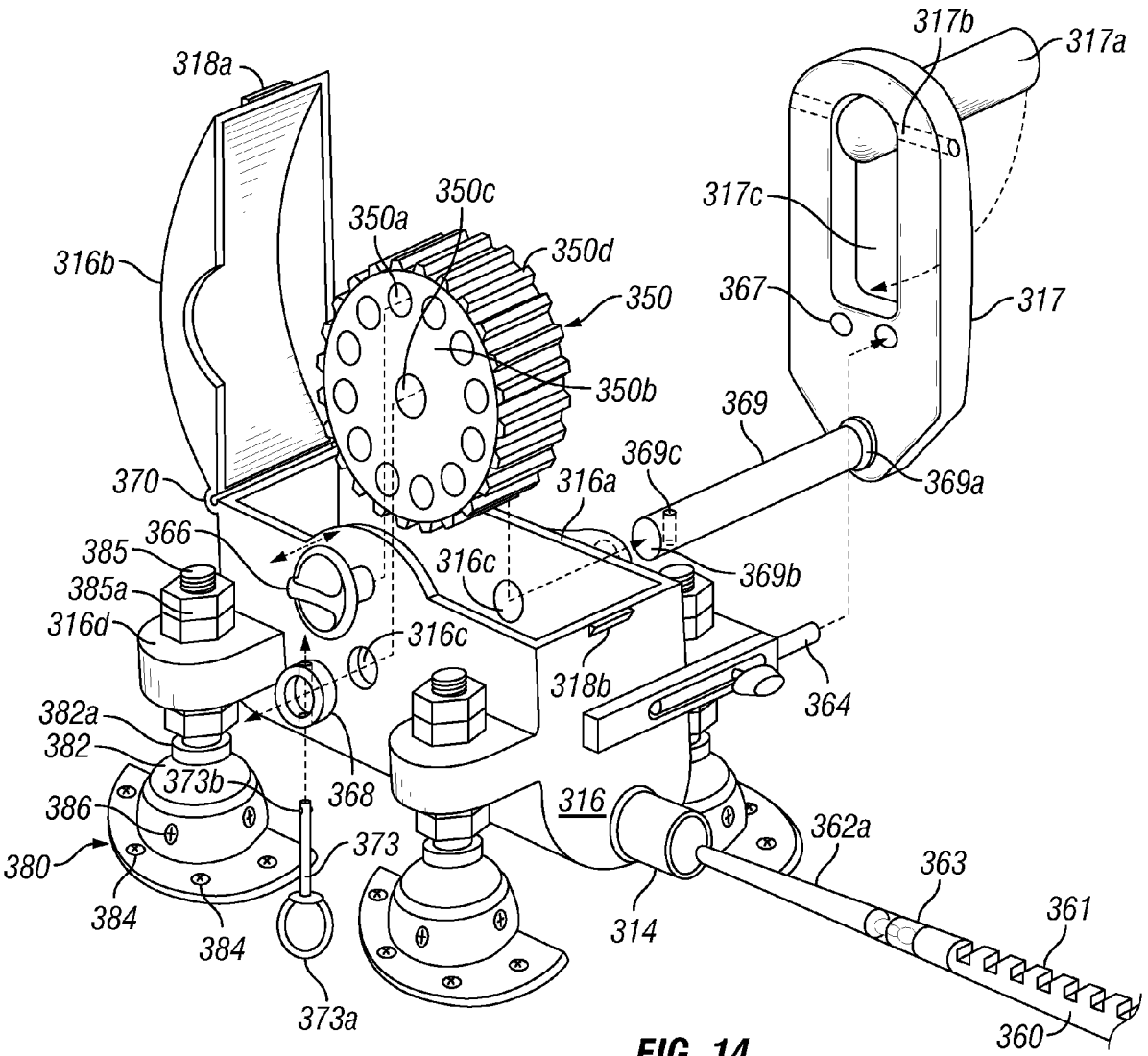
FIG. 14 is an exploded perspective view of the gear box of the anchoring system embodiment of FIG. 13.

As illustrated in, e.g., FIG. 14, the gear box housing 316 may comprise a base section 316*a* and a top section 316*b* that may be removed to permit access to the interior of the gear box. For example, the gear box 316 may comprise a hinge 370 to connect the top section 316*b* in hinged relationship to the base section 316*a*. Suitable closure devices 318*a*, 318*b* permit the top section 316*b* to be secured in place to the base section 316*a*. It will be understood that the gear box top section 316*b* may also be removably secured to the base section 316*a* with any number of suitable fasteners known in the art.

A gear wheel 350 is located inside gear box 316 and is operatively connected to handle 317 via, e.g., gear axle 369. The operable connection, as is well understood in the art, may include, for example, an axially-oriented shoulder tongue (not shown) on the inner face of the gear wheel's central aperture 350*c* to mate in receiving relationship with an axially-oriented groove (not shown) in axle 369 to thereby lock the axle 369 to the gear wheel 350 for rotational movement. Other mechanisms for securing the operable connection of the gear axle 369 to the gear wheel 350 include friction, tapered fit, or the like. The axle 369 is mounted in the gear box 316 with suitable axle mounts 316*c*. For example, the axle mounts 316*c* could comprise apertures or aperture bushings. The axle 369 is secured in place with a suitable fastener of the types known in the art.

In one embodiment (see FIG. 14), the axle mounts 316*c* are apertures for receiving the diameter of the axle 369. The axle 369 is fixably attached at one end 369*a* to the handle 317, and has a length sufficient to extend through the width of the gear box 316. The opposite end 369*b* of the axle 369 may contain a transverse aperture 369*c* for receiving a locking pin 373 or other fastener. The axle 369 may be secured in place with a retainer ring 368 suitably apertured for receiving the locking cotter pin 373. The locking pin 373 of this embodiment has at one end a ring 373*a* or other handle structure for grasping, and at the opposite end, a mechanism 373*b* for securing the pin in place such as an aperture for receiving a cotter pin, or a spring loaded ball bearing, to retain the pin in place once installed. Ideally, the pin is of a release pin variety to permit rapid connection and securing of the work pieces (or rapid disconnection). In one embodiment, the locking pin is a release pin comprising a handle, a shaft, and spring loaded ball bearings wherein depressing a spring loaded button on the handle will free up the ball bearings (and releasing the button will lock the ball bearings in place). The size of the locking pin 373 will be configured so that the axle 369 is free to rotate without the pin causing any obstruction.

The handle 317 may be a fixed configuration, or comprise a collapsible configuration where, for example, hand hold 317*a* may be rotatably connected to the handle body 317 via rotational connection 317*b* at one end to permit hand hold 317*a* to be collapsed or tucked into a handle body recessed area 317*c* to present a lower profile when not in use.

Figure 15:
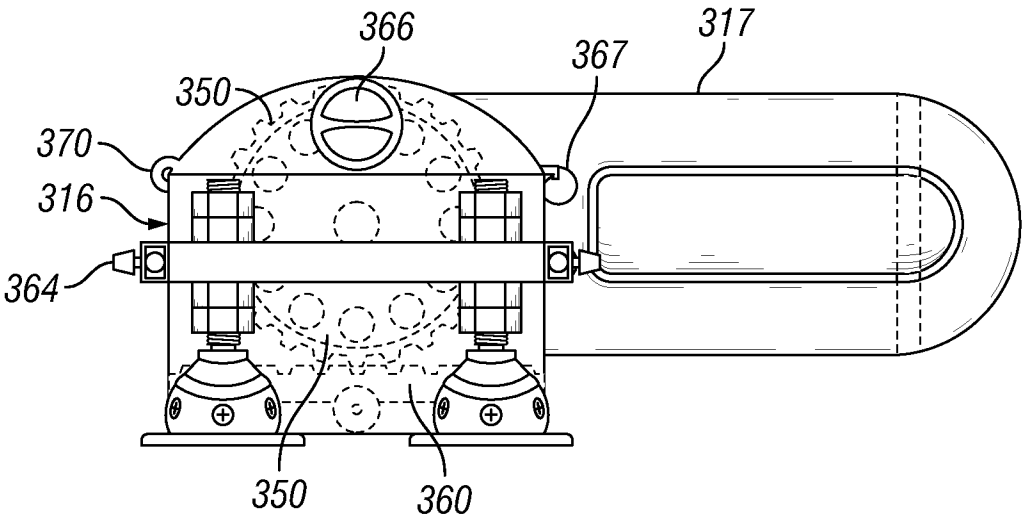
FIG. 15 is an elevation left side view of the gear box of the anchoring system embodiment of FIG. 13.
Figure 16A:
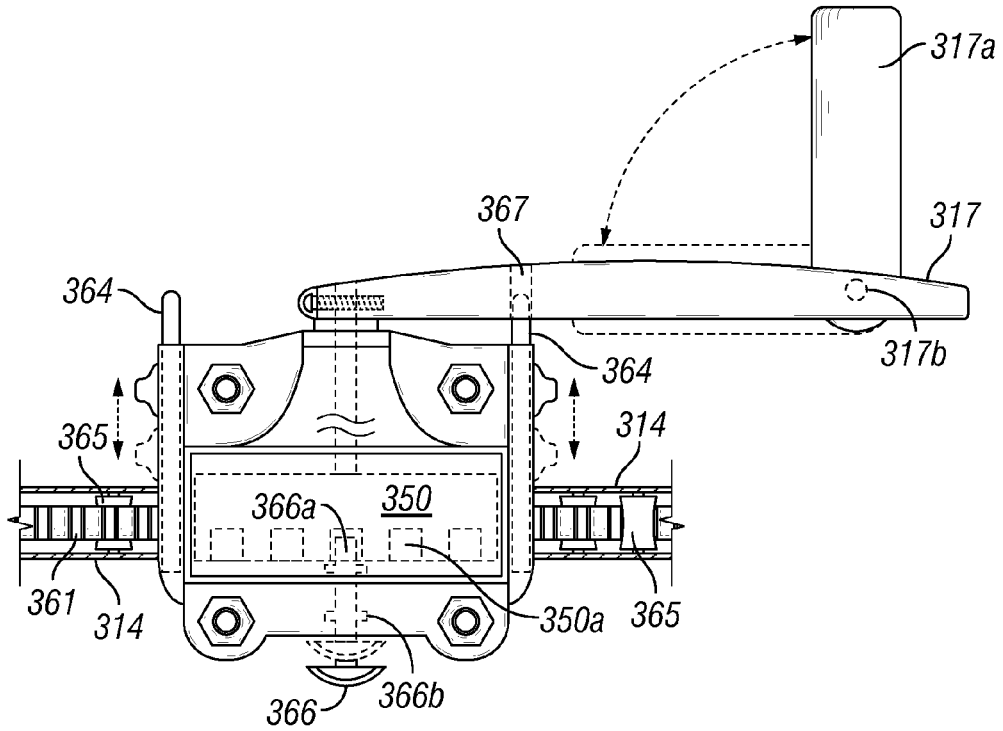
FIG. 16A is a top side partial cross sectional view of the gear box of the anchoring system of FIG. 13.

Much like as discussed with the prior embodiments in the earlier figures, the gear box 350 is suitably mounted to the kayak. For example, in one embodiment, the gear box may be secured to the kayak in similar fashion to that described above in connection with FIG. 4B. For example, referring to FIG. 14, gear box 316 may advantageously be secured to kayak 310 by utilizing a plurality of mounting assemblies 380 that are secured to mounts 316*d* located on the gear box 316. As depicted in FIG. 14, the mounts 316*d* may be simple flange tabs as shown, or part of a longitudinal flange, such as shown in FIGS. 15 and 16A, for example. One skilled in the art having the benefit of the present disclosure will understand that countless alternative mechanisms and configurations can exist for achieving such mounts. In one embodiment, four such mounting assemblies 380 are utilized. In this embodiment, mounting assembly 380 comprises base material 381 (not shown) (see FIG. 4B, 81) on which rotating ball 382 is disposed. A mounting base 383 fits over the cylindrical extension 382*a* of rotating ball 382 and is secured to the kayak 310 by utilizing a plurality of mounting screws 384. Adjusting bolt 385 may then engage the threaded portion of cylindrical extension 382*a*, and the orientation of adjusting bolts 385 may be determined by using a plurality of set screws 386. The gear box 316 may be secured to the kayak via (via gear box mounts 316*d*) using mounting bolts 385 and one or more nuts 385*a* to position and secure the mount 316*d* to the bolt 385.

The teeth 350*d* of gear wheel 350 engage the toothed portion 361 of shaft 360. The shaft 360 also includes opposed probe portions 362*a* and 362*b* which may advantageously be respectively coupled to the toothed portion 361 by utilizing connector bolts 363. In one embodiment, the probe portions 362*a* and/or 362*b* may also comprise a toothed section 359 for engaging the teeth on the gear wheel 350. Similar to FIG. 3A and FIG. 6, a plurality of rollers 365 may be included in tube 314 to facilitate movement of the shaft 360 in the tube 314 by reducing friction.

As the handle 317 is rotated in a first direction, the probe portion 362*b* of shaft 360 is deployed from a first end 314*b* of tube 314 and penetrates the bottom 324 of the body of water in which kayak 310 is floating. As the handle 317 is rotated in a second (opposite) direction, the shaft 360 is retracted into tube 314 and brings probe 362*b* back into tube 314 into a storage position. If desired, continuing to rotate the handle in the second (opposite) direction will permit the opposite probe 362*a* to deploy from the opposite (second) end 314*a* of tube 314 and penetrate the bottom 324 of the body of water. As such, in this embodiment, the shaft 360 may be moved in either direction within the tube 314 depending upon whether it is desired to deploy the anchor probe (362*a*, 362*b*) on shaft 360 from the bow 311 of the kayak or the stern 312 of the kayak 310.

Figure 16B:
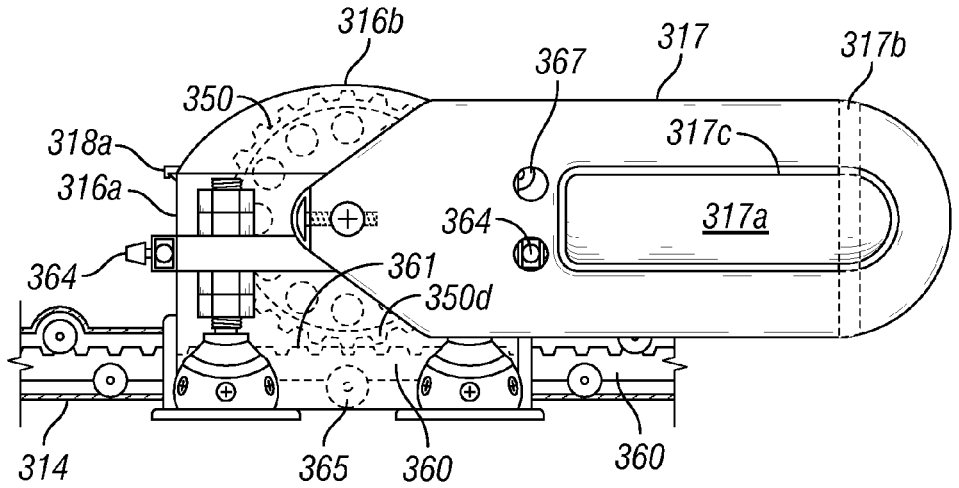
FIG. 16B is an elevation right side partial cross sectional view of the gear box of the anchoring system embodiment of FIG. 13.

In some situations, it may be desirable to lock the anchoring system in place, either during anchoring use or when the anchor is stored. There are two exemplary locking embodiments described herein. In one embodiment, a locking slide 364 is employed. The locking slide 364 will slide into locking slide holes 367 which are located on handle 317. As will be understood, the locking slide 364 serves as one mechanism for locking the handle 317 so that the handle cannot rotate. Referring to FIG. 16A and FIG. 16B, the locking slide 364 is shown in a locked position within a slide hole 367.

Figure 17B:
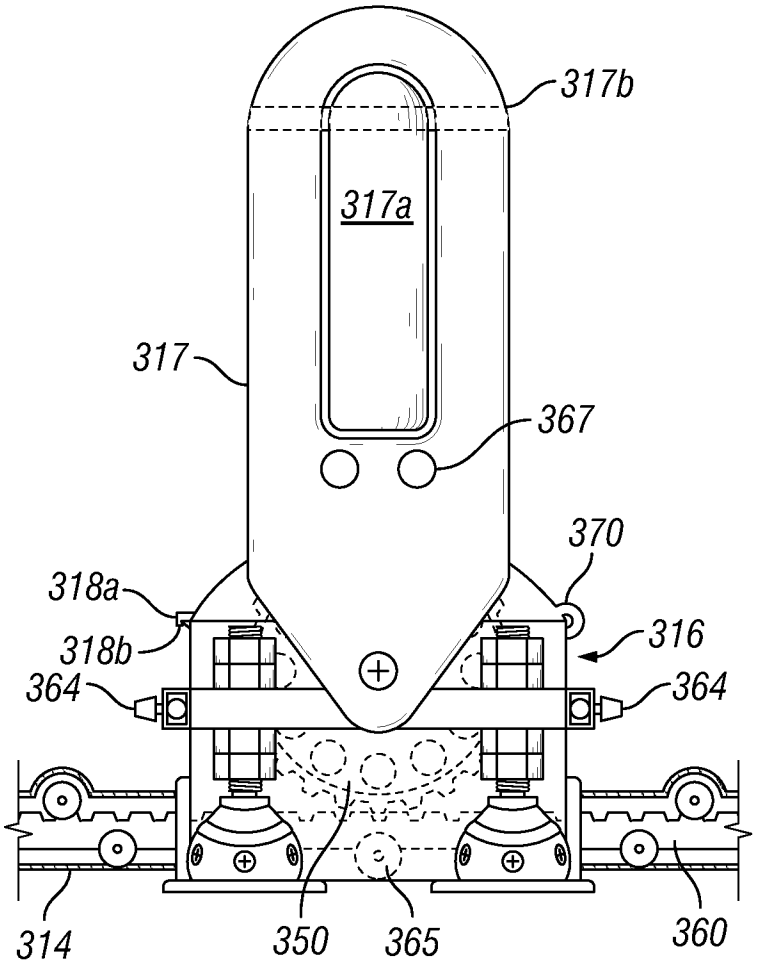
FIG. 17B is an elevation right side partial cross sectional view of the gear box of the anchoring system embodiment of FIG. 13.
Figure 17A:
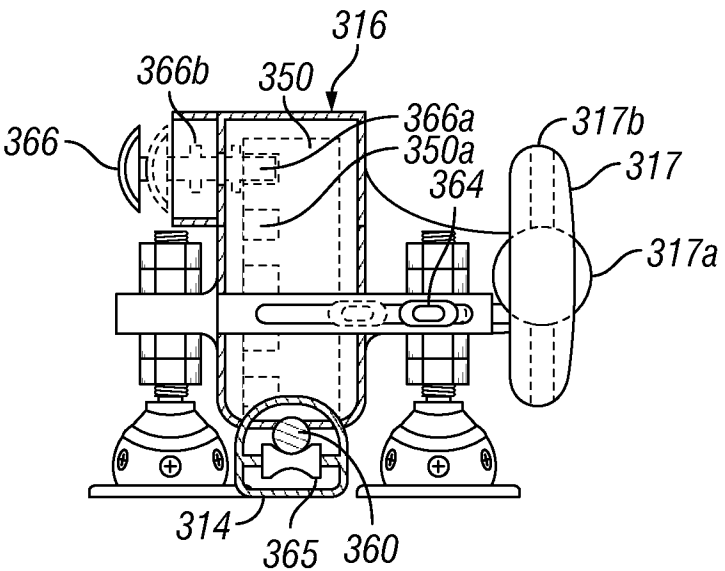
FIG. 17A is an elevation rear end partial cross sectional view of the gear box of the anchoring system embodiment of FIG. 13.
Figure 18:
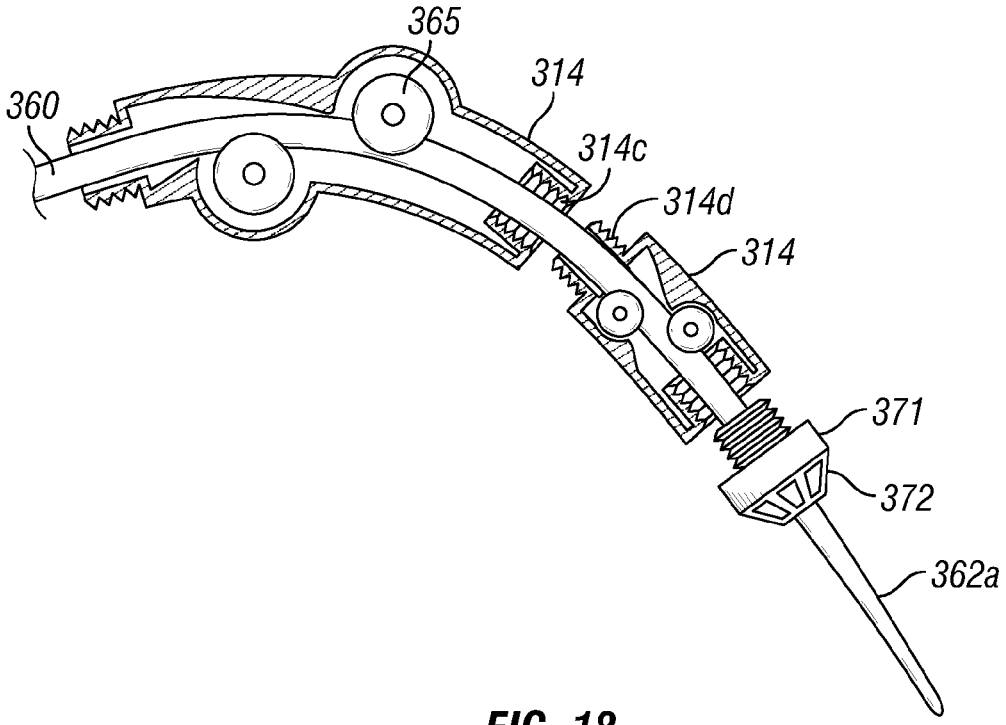
FIG. 18 is an elevation partial cross sectional view of an end of the tubing according to an embodiment of the present invention.
Figure 19:
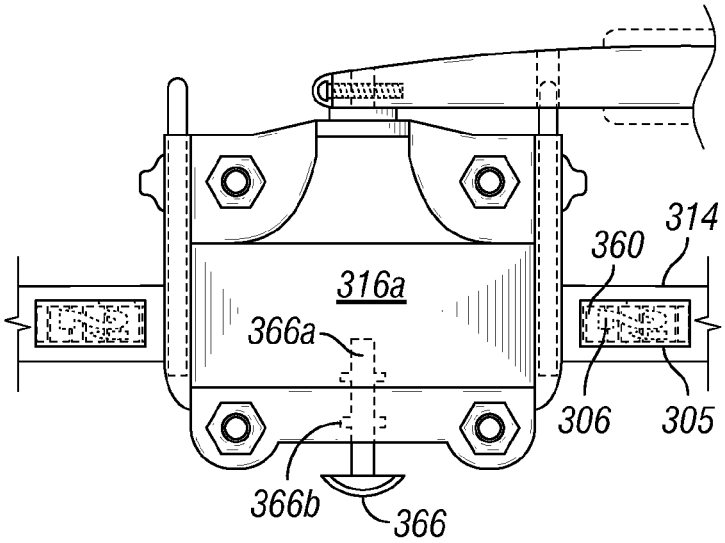
FIG. 19 is a top side partial view of the gear box of the anchoring system of FIG. 13.

Another option for locking the anchoring system in place may be achieved with the use of a locking pin 366 to engage and lock in place the gear wheel 350. In one embodiment, the locking pin 366 may be located on gear box 316, on the opposite side of handle 317. Locking pin 366 has a locking shaft section 366*a* that may be inserted into a receiving well 350*a* (or into one of a plurality of receiving wells 350*a*) located on the side face 350*b* of gear wheel 350 is to engage and lock gear wheel 350 inside gear box 316. In one embodiment, locking pin 366 is slidably mounted on gear box 316 to permit movement, when desired, from a first, disengaged position (not in contact with gear wheel 350) to a second, engaged position where the pin 366 engages the gear wheel 350, e.g., by moving locking shaft section 366*a* into one of the one or more receiving wells 350*a*. The locking shaft 366*a* can employ one or more shoulder stops 166*b* to regulate movement. It will be apparent from the various views in the drawings that the locking pin 366 can be mounted to the housing in many different ways to achieve the desired interaction between the pin and the gear. For example, in FIG. 14, a simple pin mechanism 366 is capable of being inserted through the housing and into contact with the gear, e.g., into a gear receiving well 350*a*. This pin could be completely removable if desired, and could be attached to the housing with a suitable wire or chain (not shown) to prevent it from becoming lost. In FIGS. 16A and 19, the pin 366 is depicted as being mounted within the mounting flange structure, and incorporating shoulders to keep the pin from falling out. In FIG. 17A, the pin 366 is mounted on its own flange structure. Countless other suitable pin arrangements will be apparent to one of ordinary skill in the art having the benefit of this disclosure.

It will be apparent to one of ordinary skill in the art having the benefit of this disclosure that many different locking configurations could be employed to prevent rotational movement of the gear wheel when desired, or to otherwise prevent the shaft from moving, or slipping while anchored.

The gear box assembly 316 preferably permits disassembly and removal of the gear wheel 350. For example, the gear box assembly 316 preferably comprises a housing having an openable and closeable access to permit maintenance of the gear works. This would permit routine maintenance or on demand maintenance in the event that the probe is lodged or stuck. For example, the gear box 316 can be opened via hinge 370. Locking pin 373 can be pulled out of axle retainer ring 368. Handle 317 along with axle 369 can be pulled out of gear box 316. Then gear wheel 350 can be pulled out the top. Shaft 360 can be pulled out either end of tube 314. Also, for maintenance and emergency, tube 314 may optionally employ an end cap 371 that unscrews to pull end shaft 360 and 362 out of end of tube 314.

In another embodiment, the tube 314 may further comprise an end cap 371, attachable to the ends 314*a*, 314*b* of tube 314, wherein the end cap 372 further comprises a scraper/cleaner 372 to clean or wipe mud and other debris off of the shaft 360 and or probe 362*a*, 362*b*. The scraper/cleaner 372 preferably comprises a sloped face section as shown to deflect mud and debris away from the probe 362*a* (or shaft 360) as the probe (or shaft 360) enters the tube 314. The sloped section may be configured as a unitary construction (as shown) or comprise a plurality of sloped tabs, teeth or wipers (not shown). The scraper may be formed of a rigid or flexible material.

Referring also to FIGS. 11-13 and 18, the tube 314 may be constructed in single lengths or in sections that may be attachable with suitable fittings, such as mated threaded fittings 314*c*, 314*d* or the like.

In one embodiment of the present invention, the overall length of the shaft 360 is approximately the same length as the overall length of the tube 314. In another embodiment, the combined length of the opposed probe sections 362*a*, 362*b*, and the shaft 360, is approximately the same length as the overall length of the tube 314. In another embodiment, the combined length of one probe section 362*a* and the shaft 360, is approximately the same length as the overall length of the tube 314.

Accessories may be provided with anchoring apparatus to the present invention. For example, such accessories may include foldable lights 8 and 9, which are attached to tubes 314. These would permit the kayak to be identified when lighting is dim. Additionally, such accessories may include depth indicators on the shaft 360, which may be implemented by forming a window 305 on tube 314 and applying markings 306 to the shaft 360 to indicate the depth to which the shaft 360 has been deployed. An additional accessory may comprise one or more paddle holders 307.

What is claimed is:

1. Apparatus for anchoring a kayak to the bottom of a body of water, the kayak comprising a hull having a bow and a stern and upper and lower portions, and a seat disposed in the hull between the bow and stern, the anchoring apparatus comprising:

a tube for attachment to the kayak proximate the upper portion of the kayak between the bow and the stern of the kayak, wherein the tube has first and second opposed ends, a central substantially horizontal section between the opposed ends, and a length equal to approximately the length of the kayak, and wherein the tube ends are directed generally downward;

a shaft in the tube, wherein the shaft has first and second opposed ends; and a gear box for attachment to the kayak proximate the seat which comprises: (i) a gear for operative engagement with the shaft; and (ii) a rotatable handle external to the gear box for operative connection to the gear in the gear box; the rotation of the handle in a first direction causing the shaft to deploy from a position inside the tube to a position outside the tube from the generally downwardly directed first tube end and into engagement with the bottom of the body of water; the rotation of the handle in a second direction, opposite the first direction, causing the shaft, if already deployed, to return into the tube, and if desired, to deploy from a position inside the tube to a position outside the tube from the generally downwardly directed second tube end and into engagement with the bottom of the body of water.

2. The apparatus of claim 1, wherein the shaft is deployed from the tube at a location proximate to the bow of the kayak.

3. The apparatus of claim 1, wherein the shaft is deployed from the tube at a location proximate to the stern of the kayak.

4. The apparatus of claim 1, further comprising rollers in the tube on which the shaft moves as it is deployed.

5. The apparatus of claim 1, further comprising at least one connector bolt in the shaft to permit rotation of the shaft as it is deployed.

6. The apparatus of claim 1, wherein it further comprises one or more accessories selected from the group consisting of: a foldable light which is attached to the tube; a depth indicator for the shaft; and a paddle holder.

7. The apparatus of claim 1, wherein the shaft further comprises a rack and pinion gear driven shaft.

8. The apparatus of claim 1, wherein the shaft further comprises a toothed portion for operative engagement with the gear in the gear box.

9. The apparatus of claim 1, wherein the shaft further comprises a probe portion on the end of the shaft that is deployed from the tube, for engagement with the bottom of the body of water.

10. The apparatus of claim 1, wherein the shaft further comprises a probe portion on each end of the shaft, for engagement with the bottom of the body of water, when one end of the shaft is deployed from the tube.

11. The apparatus of claim 10, wherein the probe portion is rotatably attached to the shaft with a connector bolt.

12. The apparatus of claim 10, wherein the probe portions are rotatably attached to the shaft with connector bolts.

13. The apparatus of claim 1 further comprising a locking mechanism for preventing the gear from turning.

14. The apparatus of claim 1 further comprising a locking mechanism for preventing the shaft from moving.

15. The apparatus of claim 1 wherein the handle is collapsible into a storage position.

16. The apparatus of claim 1 wherein the opposed ends of the tube further comprise a scraper to scrape debris off of the deployed shaft as the deployed shaft is directed back into the tube.

17. The apparatus of claim 1 wherein the gear box further comprises a housing having an openable and closeable access to permit maintenance of the gear works.

18. The apparatus of claim 1 wherein the tube comprises attachable and detachable tube segments.

19. A kayak anchoring system for anchoring a kayak to the bottom of a body of water, comprising:

a. a kayak comprising a hull having a bow and a stern and upper and lower portions, and a seat disposed in the hull between the bow and stern;

b. a tube for attachment to the kayak proximate the upper portion of the kayak between the bow and the stern of the kayak, wherein the tube has first and second opposed ends, a central substantially horizontal section between the opposed ends, and a length equal to approximately the length of the kayak, and wherein the tube ends are directed generally downward;

c. a shaft in the tube, wherein the shaft has first and second opposed ends; and d. a gear box for attachment to the kayak proximate the seat which comprises: (i) a gear for operative engagement with the shaft; and (ii) a rotatable handle external to the gear box for operative connection to the gear in the gear box; the rotation of the handle in a first direction causing the shaft to deploy from a position inside the tube to a position outside the tube from the generally downwardly directed first tube end and into engagement with the bottom of the body of water; the rotation of the handle in a second direction, opposite the first direction, causing the shaft, if already deployed, to return into the tube, and if desired, to deploy from a position inside the tube to a position outside the tube from the generally downwardly directed second tube end and into engagement with the bottom of the body of water.

20. Apparatus for anchoring a kayak to the bottom of a body of water, the kayak comprising a hull having a bow and a stern and upper and lower portions, and a seat disposed in the hull between the bow and stern, the anchoring apparatus comprising:

a tube for attachment to the kayak proximate the upper portion of the kayak between the bow and the stern of the kayak, wherein the tube has first and second opposed ends, a central substantially horizontal section between the opposed ends, and a length equal to approximately the length of the kayak, and wherein the tube ends are directed generally downward;

a shaft in the tube, wherein the shaft has first and second opposed ends capable of engagement with the bottom of the body of water when deployed from the tube; and a gear box for attachment to the kayak proximate the seat which comprises: (i) a gear for operative engagement with the shaft; and (ii) a rotatable handle external to the gear box for operative connection to the gear in the gear box; the rotation of the handle in a first direction causing the shaft to move in a first direction, the rotation of the handle in a second direction causing the shaft to move in a second direction opposite the first direction; the first end of the shaft being deployable in and out of the first end of the tube, the second end of the shaft being deployable in and out of the second end of the tube.

* * * * *